US010450759B1

(12) United States Patent
Carmody et al.

(10) Patent No.: US 10,450,759 B1
(45) Date of Patent: Oct. 22, 2019

(54) POST PROTECTORS

(71) Applicants: Kane Carmody, Janesville, WI (US); Jennifer Carmody, Janesville, WI (US)

(72) Inventors: Kane Carmody, Janesville, WI (US); Jennifer Carmody, Janesville, WI (US)

( * ) Notice: Subject to any disclaimer, the term of this patent is extended or adjusted under 35 U.S.C. 154(b) by 0 days.

(21) Appl. No.: 16/045,219

(22) Filed: Jul. 25, 2018

(51) Int. Cl.
*E04F 13/073* (2006.01)
*E01F 15/14* (2006.01)

(52) U.S. Cl.
CPC ..... *E04F 13/0736* (2013.01); *E01F 15/141* (2013.01)

(58) Field of Classification Search
CPC ..... E04H 12/2292; E04F 15/141; E04F 13/0736; E01F 15/141; E01F 15/0469; A01G 9/28; F16B 5/0036
See application file for complete search history.

(56) References Cited

U.S. PATENT DOCUMENTS 942,761 A * 12/1909 Voynow ..... E04H 12/2292 52/835
1,609,874 A * 12/1926 Heydon ..... E04H 12/2292 138/157
1,999,098 A * 4/1935 Hillyer ..... E04H 12/2292 52/98
3,291,437 A * 12/1966 Bowden ..... E04G 13/021 249/48
3,951,294 A * 4/1976 Wilson ..... B65F 1/02 220/4.31
5,375,369 A * 12/1994 VerHoeve ..... A01G 9/28 47/33
5,622,356 A 4/1997 Duggan
5,956,920 A 9/1999 Davis
6,357,196 B1 3/2002 McCombs
7,104,525 B2 * 9/2006 Ricci ..... E04H 12/2292 256/1
7,997,044 B2 * 8/2011 Green ..... A47B 96/202 220/6
8,959,871 B2 * 2/2015 Parenti ..... E04C 3/36 52/170
9,482,023 B1 * 11/2016 Carmody ..... E04H 12/2292
2005/0229531 A1 10/2005 Green et al.
2006/0010823 A1 1/2006 Waters et al.
(Continued)

*Primary Examiner* — Andrew J Triggs
(74) *Attorney, Agent, or Firm* — Brian S. Steinberger; Hilary F. Steinberger; Law Offices of Brian S. Steinberger, P.A.

(57) ABSTRACT

Devices, apparatus, kits, systems and methods for protecting sides of wood, plastic or metal posts from damage with easily attachable plastic panels. The panels can provide marking surfaces for addresses on mailbox posts, as well as a surface for applying desirable colors and indicia designs thereon. The panels can each have one side edge with a C shape with open socket, and an opposite side edge with an arrow tip and catch. The panels can attach to one another by having orienting and positioning the arrow tip and catch on top of and into the open socket of the C shape edge. Alternatively, the panels can attach to one another by pushing the side edge with the arrow tip and catch sideways into the open socket of the C shape side edge so that arrow tip and catch snap within the socket of C shape side edge. Plural panels can be attached about a base of a post such as a rectangular or circular cross-section mailbox post or fence post or deck post, and the like.

15 Claims, 10 Drawing Sheets

(56) References Cited

U.S. PATENT DOCUMENTS

| | | | | |
|---|---|---|---|---|
| 2007/0245645 | A1 | 10/2007 | Nesbitt | |
| 2008/0000192 | A1 | 1/2008 | McGlinch | |
| 2010/0223882 | A1* | 9/2010 | Parenti | E04C 3/36 52/834 |
| 2010/0236182 | A1* | 9/2010 | Mackenzie | E04C 3/30 52/588.1 |

* cited by examiner

POST PROTECTORS

FIELD OF INVENTION

This invention relates to posts for mailboxes, fences and decks, and in particular to devices, apparatus, kits, systems and methods for protecting sides of new or existing posts by attaching side edges of rectangular panels together by interconnecting C shaped edges with open sockets with opposite side edges having arrow tips with catches, with the panels made from a durable material, and for providing marking surfaces, such as addresses for the posts, as well as a surface for applying desirable colors and indicia designs thereon.

BACKGROUND AND PRIOR ART

Many mailboxes are mounted on wooden, plastic or metal type posts, such as a rectangular or circular cross-sectional post. Cutting grass and weeds about the base of these posts are often done with automated cutting tools such as line trimmers, often referred to as WEED WACKERS™. These trimmers are able to trim edges of lawns by a motor driven flexible wire or plastic or nylon type cord or blade. Often the trimmers constantly striking the posts cause unsightly indentations such as grooves and cuts into the surface areas of the posts. The indentations can often attract dirt and debris that can also become discolored and tend to shorten the lifespan of the posts.

Another problem with wooden posts is that it can be difficult to place indicia such as street addresses, etc., since tape type lettering and numbering often does not stick to the wooden surfaces. Nailing numbers and address indicia would not be desirable since the nails and fasteners can damage, split the wood and further reduce the post lifespan over time.

Other types of posts such as wooden, plastic or metal fence posts and wooden, plastic or metal deck posts can also have similar problems where rotating trimmer lines also cause unsightly indentations, that also can become discolored, and can shorten the lifespan of the posts over time.

Thus, the need exists for solutions to the above problems with the prior art.

SUMMARY OF THE INVENTION

A primary objective of the present invention is to provide devices, apparatus, kits, systems and methods for protecting sides of posts such as wooden, plastic or metal mailbox posts, fence posts, deck posts and pergola posts with easily attachable plastic panels.

A secondary objective of the present invention is to provide devices, apparatus, kits, systems and methods for marking surfaces on wooden, plastic or metal posts and/or mailbox posts and/or fence posts and/or deck posts and/or pergola posts for addresses and for desirable colors and indicia designs thereon.

A third objective of the present invention is to provide devices, apparatus, kits, systems and methods for protecting sides of wooden, plastic or metal mailbox posts from nicks, cuts and scrapes from lawn maintenance equipment and further improves the appearance the property.

A fourth objective of the present invention is to provide devices, apparatus, kits, systems and methods for protecting sides of plastic posts from scuffs and damage using replaceable panels without having to replace the expensive plastic posts.

A fifth objective of the present invention is to provide devices, apparatus, kits, systems and methods for protecting sides of metal posts from scuffs and damage using replaceable panels without having to replace the expensive metal posts.

A sixth objective of the present invention is to provide devices, apparatus, kits, systems and methods for protecting sides of posts that are made of a durable material to protect and decorate the mailbox, deck, pergola, fence, garden, and utility and recreation posts.

A seventh objective of the present invention is to provide devices, apparatus, kits, systems and methods for protecting sides of posts with panels having a moisture protection barrier to protect the post from mold and mildew.

An eighth objective of the present invention is to provide devices, apparatus, kits, systems and methods for protecting sides of posts with panels have hinged corners to allow movement to better-fit cracked, warped or misshapen posts.

A ninth objective of the present invention is to provide devices, apparatus, kits, systems and methods for protecting sides of posts with panels having corners that are flattened and enhanced to reduce ware and damage to the lawn maintenance equipment.

A tenth objective of the present invention is to provide devices, apparatus, kits, systems and methods for protecting sides of posts with panels having sides made smooth with a non-abrasive surface to reduce ware and damage to the lawn maintenance equipment.

An eleventh objective of the present invention is to provide devices, apparatus, kits, systems and methods for protecting sides of posts with panels that are interchangeable, so that panels with different sizes, colors, designs, indicia, and the like, are attachable to one another.

A twelfth objective of the present invention is to provide devices, apparatus, kits, systems and methods for protecting sides of posts with panels that come in different widths and heights to protect and cover the entire post, so that panels with different colors, designs, indicia, and the like, are attachable to one another.

An embodiment of the post protector, can include a plurality of planar plastic rectangular panels, each of the panels having a C shape with open socket on a first side edge, each of the panels having catch edge on a second side edge opposite to the first side edge, wherein the plurality of panels are interconnected with one another by attaching the catch of each panel into the open socket of the C-shape of an adjacent panel, wherein the post protector is adaptable to form a barrier about a post to be protected.

Each panel can be formed from plastic with the C shape and catch edge molded into the plastic.

The plurality of rectangular panels each have identical C shape with open socket side edges and identical catch side edges.

Each of the plurality of rectangular panels can include parallel raised ribs across at least one face of the plurality of rectangular panels.

The plurality of rectangular panels can include four rectangular panels.

Each C shape can have an open socket with a generally flat outer surface. Each C shape can include rounded corners above and below the flat outer surface.

Each catch edge can include an arrow tip with a base clip edge. Each catch edge can have a half arrow shape.

A method of assembling panels to protect posts can include the steps of providing a plurality of planar plastic rectangular panels, providing each of the panels with a first side edge having a C shape with open socket, providing each of the panels with a second side edge opposite the first side edge, having catch and attaching the plurality of panels to one another by interconnecting the catch of each panel into the open socket of the C-shape of an adjacent panel until the plurality of interconnected panels forms a barrier about a post to be protected.

The step of providing the plurality of rectangular panels can include the step of providing the plurality of rectangular panels each have identical C shape with open socket side edges and identical catch side edges.

The step of providing the plurality of rectangular panels can include the step of providing a plurality of raised ribs across one face of the panels.

Each C shape with open socket can include a generally flat outer surface on the C shape.

Each C shape can include rounded corners above and below the flat outer surface.

Each catch edge can include an arrow tip with a base clip edge. And each catch edge can include a half arrow shape.

The step of attaching the plurality of the panels can include the steps of orienting and positioning the catch edge on top of the C shape so that the catch edge slides within the open socket of the C shape.

The step of attaching the plurality of the panels can include the steps of pushing the catch edge sideways into the open socket of the C shape so that the catch edge snaps into the open socket of the C shape.

While the embodiments show four panels, the invention can be used with three panels, or five or more panels.

Further objects and advantages of this invention will be apparent from the following detailed description of the presently preferred embodiments which are illustrated schematically in the accompanying drawings.

BRIEF DESCRIPTION OF THE FIGURES

The drawing figures depict one or more implementations in accord with the present concepts, by way of example only, not by way of limitations. In the figures, like reference numerals refer to the same or similar elements.

DESCRIPTION OF THE PREFERRED EMBODIMENTS

Figure 1A:
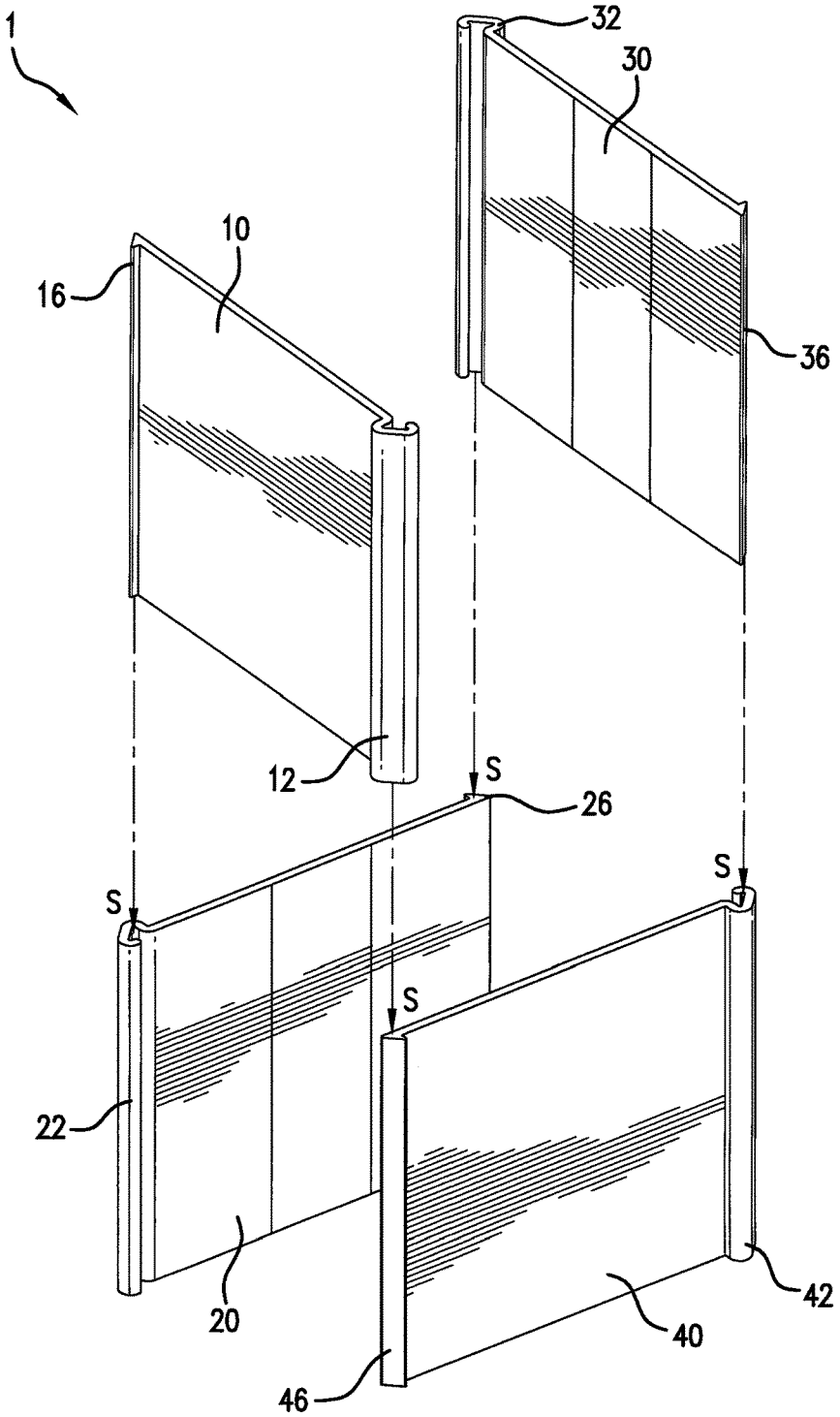
FIG. 1A is a partial exploded view of identical post panels with a flat side C shape end with open socket being slidably attachable over another end of the panel having a catch with arrow tip and base clip edge portion.

Before explaining the disclosed embodiments of the present invention in detail it is to be understood that the invention is not limited in its applications to the details of the particular arrangements shown since the invention is capable of other embodiments. Also, the terminology used herein is for the purpose of description and not of limitation.

In the Summary above and in the Detailed Description of Preferred Embodiments and in the accompanying drawings, reference is made to particular features (including method steps) of the invention. It is to be understood that the disclosure of the invention in this specification includes all possible combinations of such particular features. For example, where a particular feature is disclosed in the context of a particular aspect or embodiment of the invention, that feature can also be used, to the extent possible, in combination with and/or in the context of other particular aspects and embodiments of the invention, and in the invention generally.

In this section, some embodiments of the invention will be described more fully with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will convey the scope of the invention to those skilled in the art. Like numbers refer to like elements throughout, and prime notation is used to indicate similar elements in alternative embodiments.

A list of components referenced in the figures will now be described.

1 post protector
10 first panel
14 ribs and/or moisture strips
12 flat sided C shape with open socket
16 catch end having an arrow tip with a base clip edge.
20 second panel
22 flat sided C shape with open socket
26 catch end having an arrow tip with a base clip edge.
30 third panel
32 flat sided C shape with open socket
36 catch end having an arrow tip with a base clip edge.
40 fourth panel
42 flat sided C shape with open socket
46 catch end having an arrow tip with a base clip edge.
100 post for mailbox
200 elongated panel post protector
210 first panel
220 second panel
230 third panel
240 fourth panel The invention is an improvement on U.S. Pat. No. 9,482,023 to Carmody, which is incorporated by reference in its' entirety, which is assigned to the same inventors as the subject patent application.

The invention embodiments can be used and sized in height and width to fit about various types of rectangular or circular cross-section posts, such as but not limited to posts being approximately 4 inches×approximately 4 inches, approximately 4 inches×approximately 6 inches, approximately 6 inches×approximately 6 inches, and the like, as well as other sizes and the like.

Each of the posts sizes can have respective sized identical shaped panels, such as but not limited to having a width of approximately 4 inches and a height of approximately 4 & ½ inches.

FIG. 1A is a partial exploded view of identical post panels 10, 30 with a flat side C shape ends 12, 32 with open socket being slidably attachable over ends of the panels 20, 40 having a catch 26, 46 with arrow tip and base clip edge portion. Similarly, catches 16, 36 of panels 10, 30 can slide within open sockets of C shape ends 22, 42 of panels 20, 40.

Figure 1B:
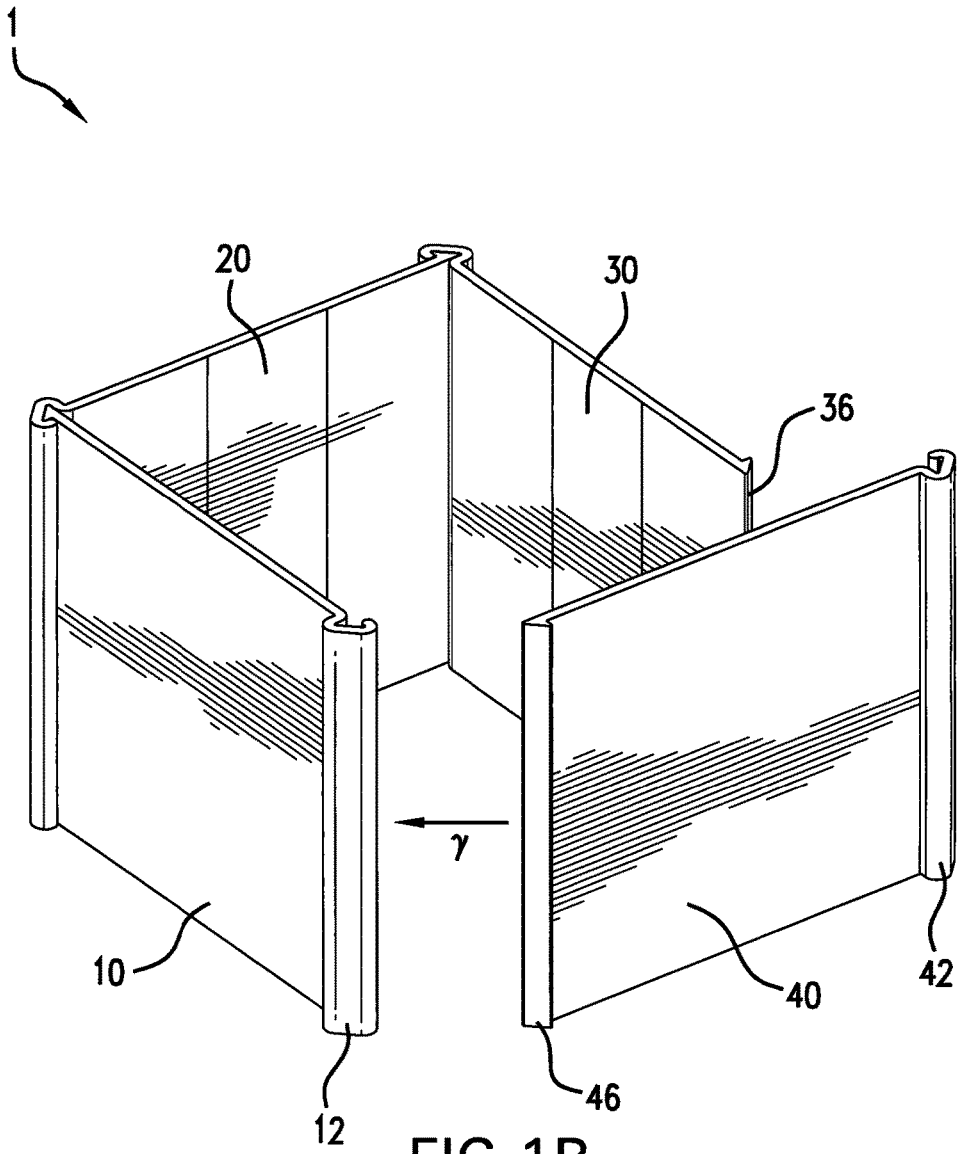
FIG. 1B is another partial exploded view of the identical post panels of FIG. 1A with one panel end having a catch with arrow tip and clip edge portion being oriented into position to snap into the open socket of the C shape end.

FIG. 1B is another partial exploded view of the identical post panels 10, 20, 30 of FIG. 1A attached to one another with one panel 40 having a catch 46 with arrow tip and clip edge portion being oriented into position to snap into the open socket of the C shape end 12.

Figure 1C:
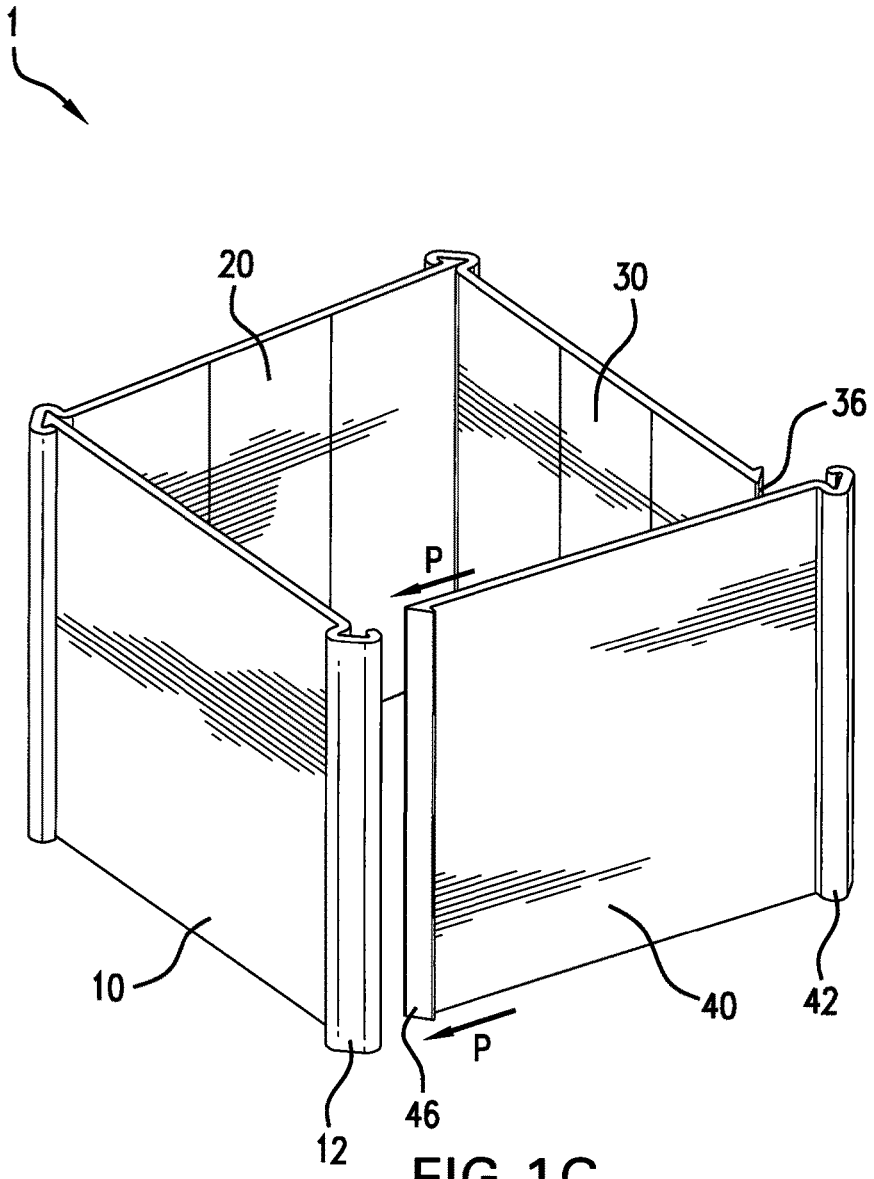
FIG. 1C shows another view of the unattached panel of FIG. 1B in position so that the arrow tips with base clip edge portions are ready to snap into respective sockets of the C shape ends.
Figure 1D:
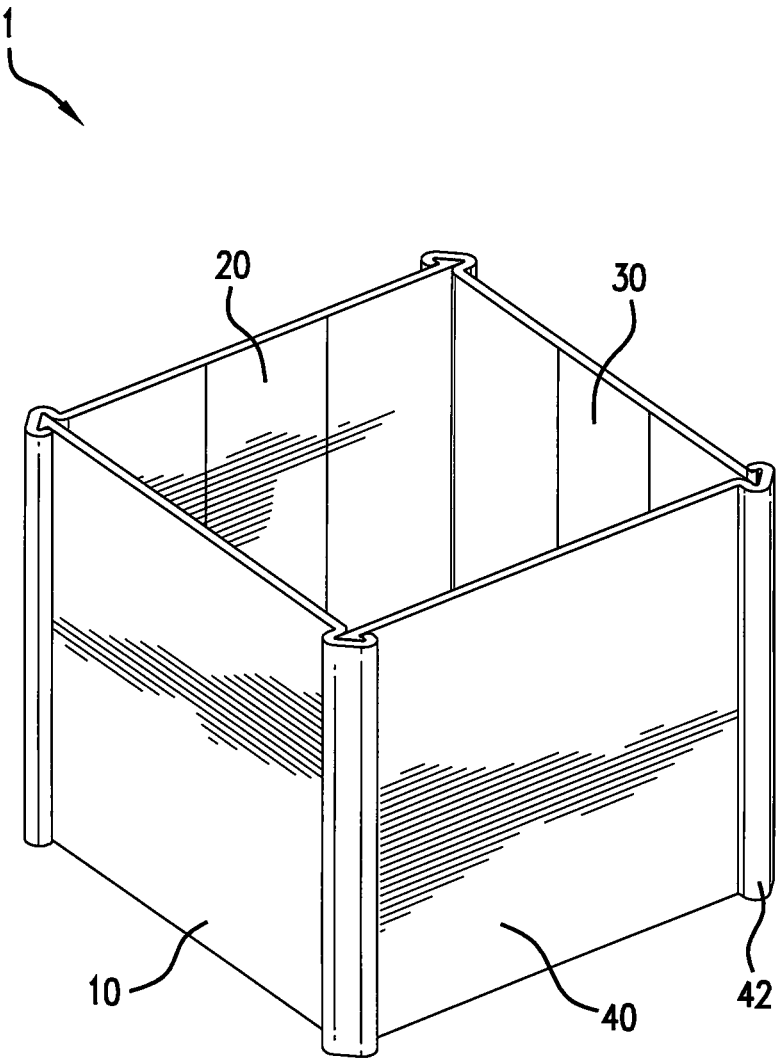
FIG. 1D shows multiple panels of the preceding figures assembled and attached together.

FIG. 1C shows another view of the unattached panel 40 of FIG. 1B in position so that the arrow tips 46, 36 with base clip edge portions are ready to snap into respective sockets of the C shape ends 12, 42 of respective panels 10 and 40. FIG. 1D shows multiple panels 10, 20, 30 and 40 of the preceding figures assembled and all attached together.

Figure 3:
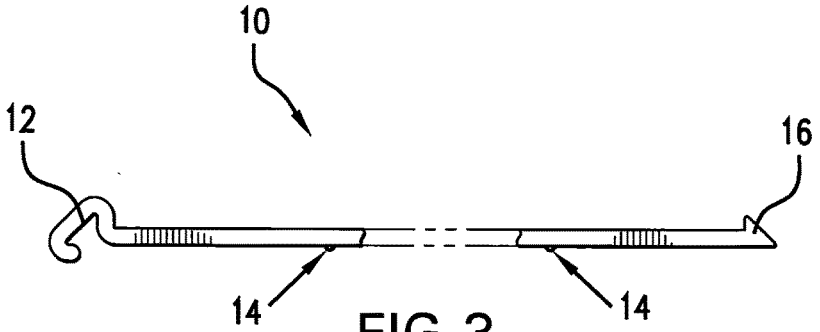
FIG. 3 is a top view of one of the panels of the preceding figures.

FIG. 3 is a top view of one of the panels 10 of the preceding figures, with each of the panels 10, 20, 30 and 40 preferably identical to one another. Each of the panels 10-40 can have one side end 12, 22, 32, 42 with flat sided C shape with open socket. The C shape can have a curved top and curved bottom with the curved top molded into the side end of the panels 10, 20, 30, 40. The opposite side end of each panel can have a catch end 16, 26, 36, 46 with an arrow tip with a base clip edge.

Figure 4:
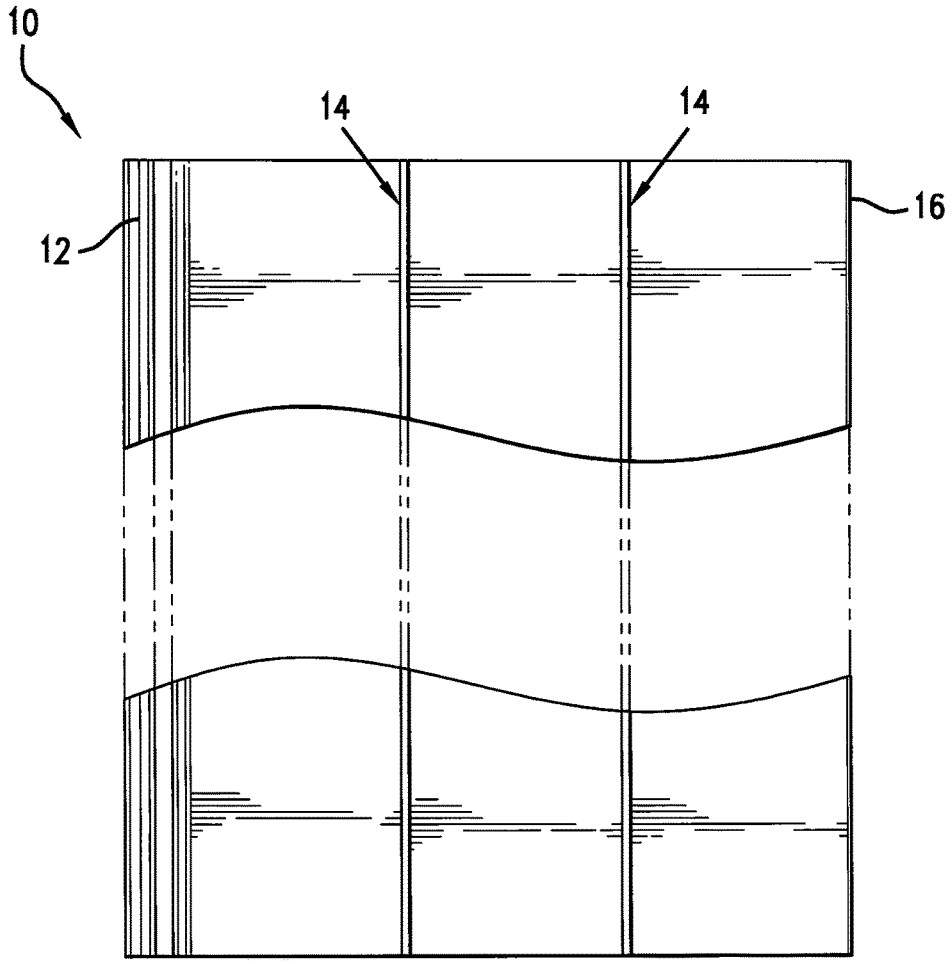
FIG. 4 is a front view of the panel of FIG. 3.

FIG. 4 shows one side face of the panel of FIG. 3.

Referring to FIGS. 3-4, across at least one face of the panels can be a plurality of raised ribs 14 that can be used as strengthening members or as moisture barrier separation spaces between the panels 10, 20, 30, 40 and the sides of the underlying posts.

While the ribs 14 are shown vertical, the ribs 14 can be arranged in horizontal parallel rows, or other configurations such as crossed, and different combinations, and the like. The ribs 14 can be raised molded on portions of the plastic panels Alternatively, components 14 can be moisture barrier strips which can protect the sides of the posts 100 from mold and mildew.

Referring to FIGS. 1A and 3-4, the catch ends 16, 36 of panels 10 and 30 can slide downward into respective socket openings of respective C shape ends 22, 42 of respective panels 20, 40. Additionally, the open sockets of C shaped ends 12, 32 of panels 10, 30 can be slid over catch ends of 46, 26 of respective panels 40, 20 so that all the panels 10, 20, 30 and 40 become attached to another.

Referring to FIGS. 1B, 1C, 1D and 3-4, the catch end 46 of panel 40 can be oriented in the direction of arrow Y and pushed in the direction of arrow P by the installer to slightly spread apart the open socket 12 of adjacent panel 10, so that the clip base of the arrow tip can then snap within the open socket of the C shape end 12 of panel 10. Each of the adjacent panels 10, 20, 30 and 40 can be similarly attached to one another in a similar push and snap assembly.

Figure 2A:
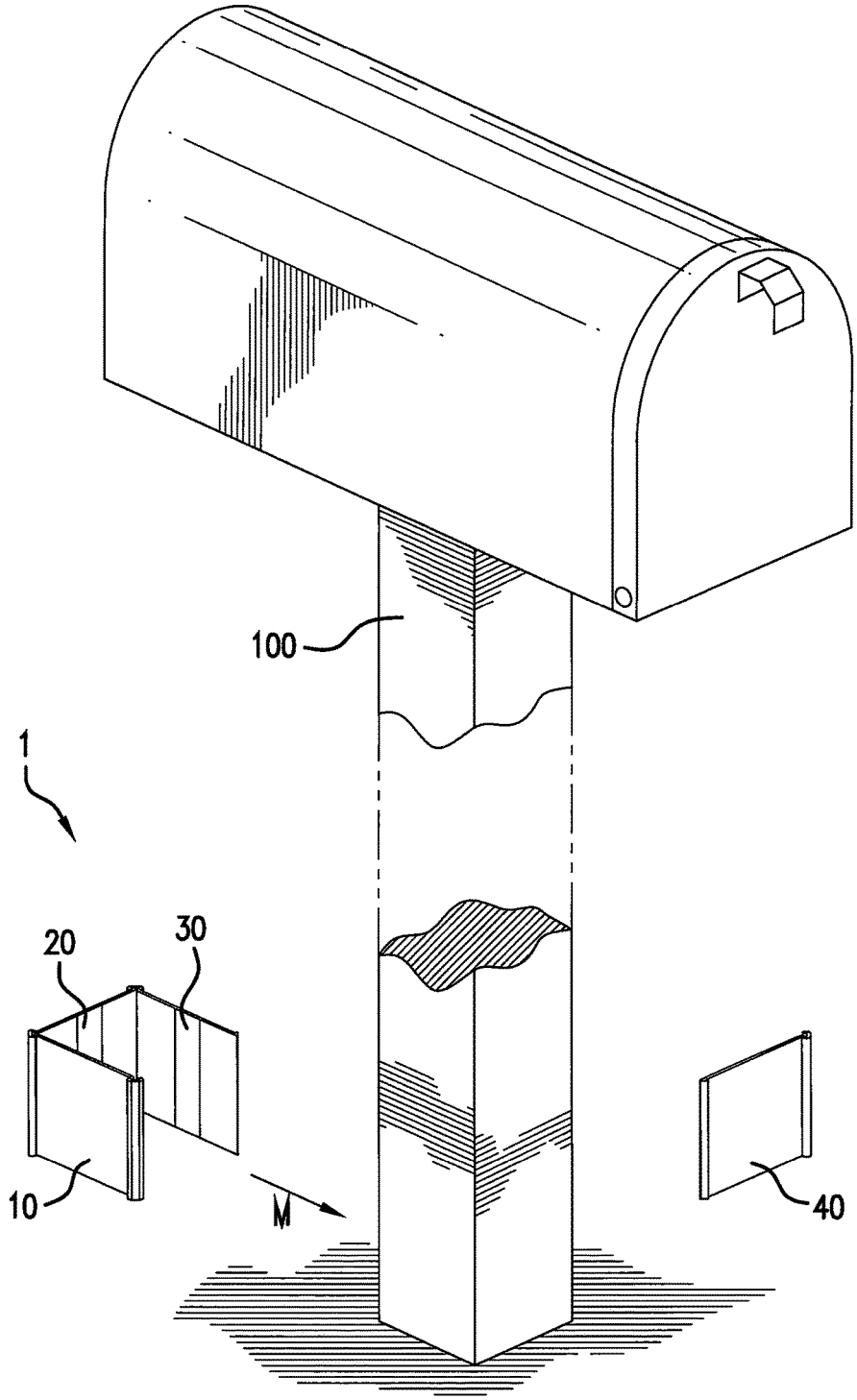
FIG. 2A shows the panels of FIGS. 1A-1D ready to assemble to a lower end of a mailbox post.
Figure 2B:
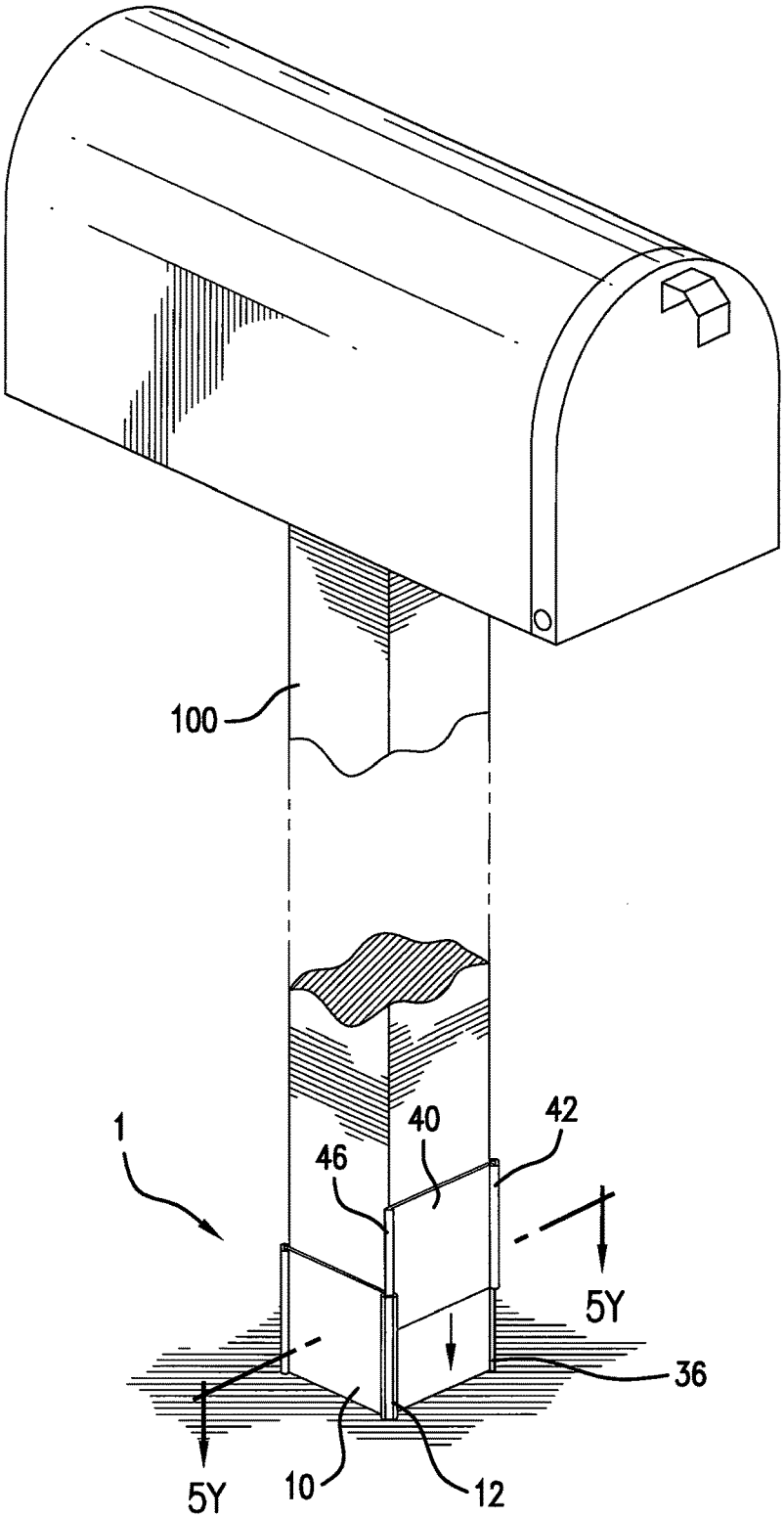
FIG. 2B the panels of FIG. 2A almost assembled about a lower end of a mailbox post.

FIG. 2A shows the panels 10, 20 and 30 of FIG. 1 ready to assemble to a lower end of a mailbox post 100. FIG. 2B the panels 10, 20, 30 and 40 of FIG. 2A almost assembled about a lower end of a mailbox post 100.

Referring to FIGS. 1A, 1B, 1C, 1D, 2A, 2B, 3-4, three of the panels 10, 20, 30 can be attached to one another about the base of the post 100 as previously described, with the last panel 40 finally attached.

Figure 2C:
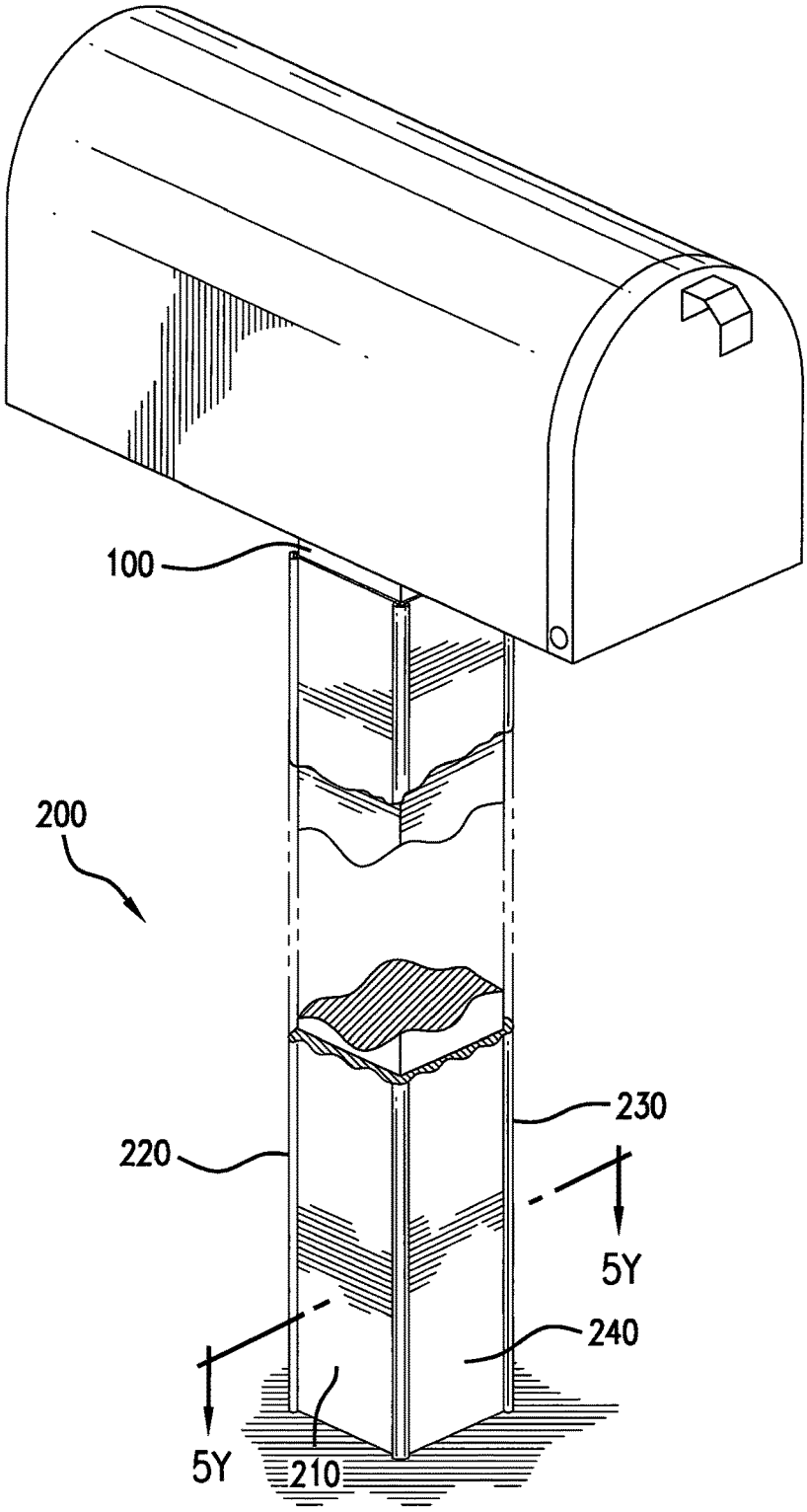
FIG. 2C shows extended length panels of FIG. 2A almost assembled about a lower end of a mailbox post.

FIG. 2C shows another embodiment 200 of extended length panels 210, 220, 230, 240, almost assembled about the entire mailbox post 100. Here, larger height panels 210, 220, 230 and 240 can be slid into place or snapped into place in a manner similar to the embodiments described above. This larger size version of panels 210, 220, 230 and 250 can be used for protecting and covering the post from lawn maintenance equipment, weathering and discoloration.

Figure 5:
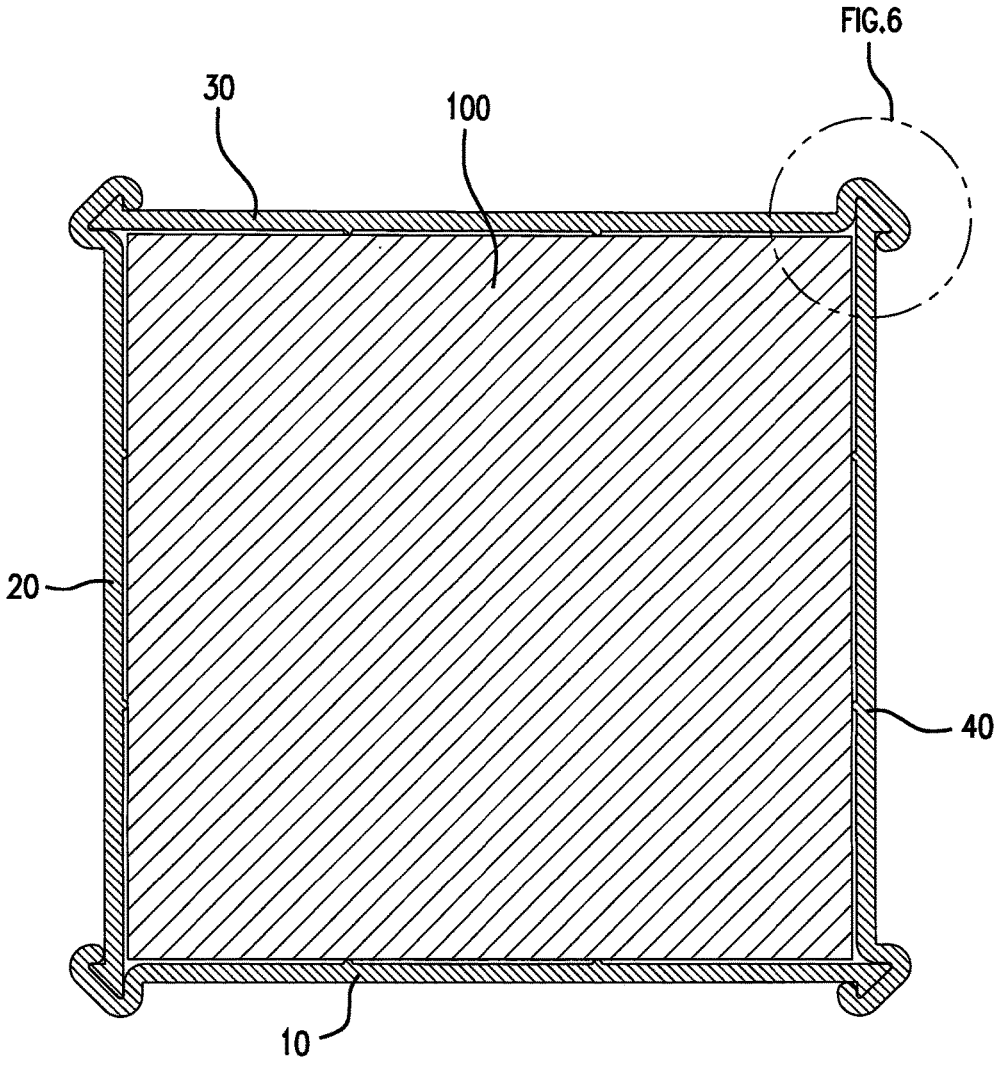
FIG. 5 is cross-sectional view of the rectangular panels attached about a mailbox post of FIGS. 2B and 2C along arrows 5Y.
Figure 6:
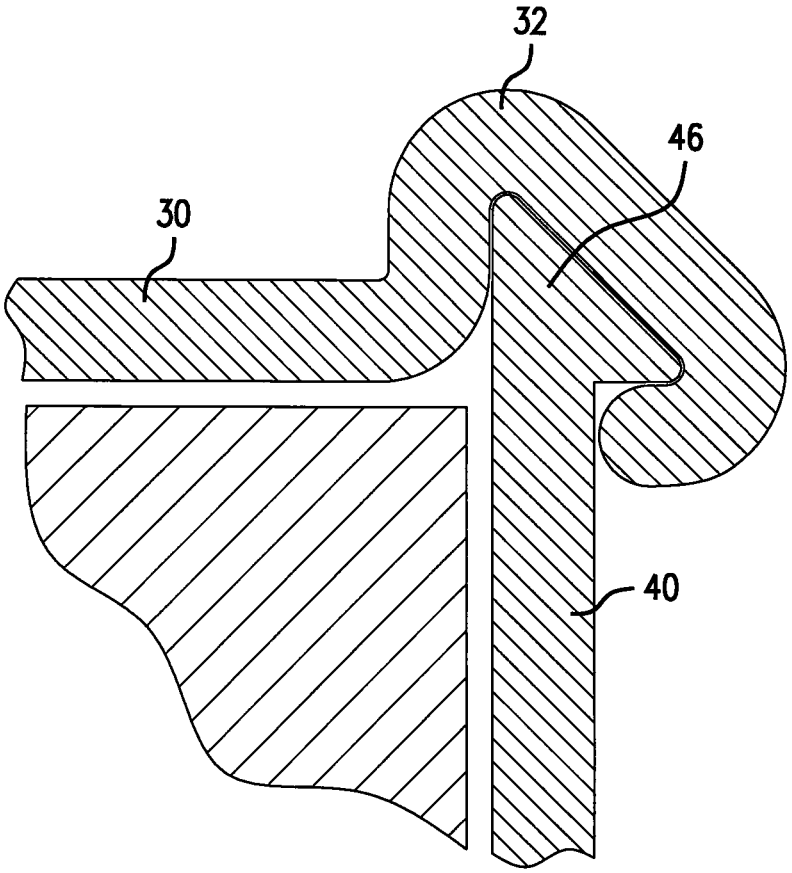
FIG. 6 is an enlarged view of one of the corners of the attached panels of FIG. 5.

FIG. 5 is cross-sectional view of the rectangular panels 10, 20, 30, 40 attached about a mailbox post 100 of FIGS. 2B and 2C along arrows 5Y. FIG. 6 is an enlarged view of one of the corners of the attached panels 30, 40 of FIG. 5 showing the catch end 46 having an arrow tip with a base clip edge of panel 40 attached with the flat sided C shape 32 with open socket of panel 30.

While the panels 10, 20, 30, 40, 210, 220, 230, and 240 are shown as generally planar panels, the invention can be used with the panels having slightly concave bent mid portions which allow at least the interior bending portions to be able to touch and/or grip against side exterior surfaces of the underlying posts.

The term "approximately" can be +/−10% of the amount referenced. Additionally, preferred amounts and ranges can include the amounts and ranges referenced without the prefix of being approximately.

The novel post protectors described above can be used to protect and cover posts from nicks, cuts and scrapes from lawn maintenance equipment and improves the appearance of the property.

The novel post protectors can be made of a durable material, such as but not limited to plastic, and the like, to protect and decorate the mailbox, deck, pergola, fence, garden, and utility and recreation posts. The panels can be formed from molded plastic, extruded plastic, and the like.

The shields can protect posts made from different materials, such as but not limited to wooden posts, plastic posts and metal posts, and the like.

The novel post protectors can protect any type of posts from scuffs and damage that has previously required the placement of the scuffed and damaged posts.

The novel panels are not required to be affixed to the underlying posts via a focal point, such as but not limited a focal point from a screw, nail, adhesive, or other fastener. Since the novel panels do not have to be affixed to the underlying post, the attached panels allow for flexibility and movement with the post, which reduces any cracking or breakage which can occur if the panels have to be affixed to the underlying posts.

The novel panels when attached together form hinged corners to allow movement to better-fit cracked, warped or misshapen posts.

The corners on each of the panels, can be rounded and enhanced to reduce ware and damage to the lawn maintenance equipment.

The sides of the panels can be made smooth with a non-abrasive surface to reduce ware and damage to the lawn maintenance equipment.

The novel panels are interchangeable with panels having different colors, different designs, and the like.

Although the embodiments show multiple panels being assembled to one another by sliding protruding portions along one side of a panel into hook portions along an adjacent panel, the post protectors can use as little as three panels attached to one another. Additionally, the panels can be assembled to have five or more panels interconnected with one another.

The panels can each be of the same size. Alternatively, different sized panels can be attached to one another to fit about different diameter posts. Although only the bases of the posts are shown protected, the panels can be arranged to run up part of or substantially up most of the sides of the posts as needed.

The panels can be formed from different indicia, such as different colors, and the like. For example, a college team colors can be combined on one panel or the panels can have different colors thereon. Additionally, other types of designs, indicia, and the like, can be painted on the panels. Also, the colors, designs, indicia and the like, can be screen printed on the panels. Additionally, other information, such as but not limited to street addresses, and the like, can be painted on the panel surfaces, or screen printed thereon, or applied by other techniques, such as but not limited to applying tape with the numbers and address information to the surfaces of the panels.

Although the hook edges are shown being longitudinal generally across the entire side edge, the hook edges can be spaced apart from one another.

While the posts being protected are generally shown having rectangular or circular cross-sections, other types of posts having cylindrical cross-sections, and other shapes can be protected.

While the panels are shown having generally flat planar surfaces, the panels can have non planar surfaces, such as but not limited to rounded surfaces for fitting about other shaped posts, such as cylindrical posts, and other non-rectangular or circular cross-section posts, and the like.

Although the panels are shown as rectangular or circular, other geometrical shapes can be used, such as but not limited to hexagon, triangular, and the like, and other shapes.

Although the figures show embodiments with identical sized panels, the invention can be practiced by combining and interchanging different sized panels together. For example, a 4 inches×4 inches panel can connect to a 6 inches by 6 inches panel.

The term "approximately" can be +1-10% of the amount referenced. Additionally, preferred amounts and ranges can include the amounts and ranges referenced without the prefix of being approximately.

Although specific advantages have been enumerated above, various embodiments may include some, none, or all of the enumerated advantages.

Other technical advantages may become readily apparent to one of ordinary skill in the art after review of the following figures and description.

It should be understood at the outset that, although exemplary embodiments are illustrated in the figures and described below, the principles of the present disclosure may be implemented using any number of techniques, whether currently known or not. The present disclosure should in no way be limited to the exemplary implementations and techniques illustrated in the drawings and described below.

Unless otherwise specifically noted, articles depicted in the drawings are not necessarily drawn to scale.

Modifications, additions, or omissions may be made to the systems, apparatuses, and methods described herein without departing from the scope of the disclosure. For example, the components of the systems and apparatuses may be integrated or separated. Moreover, the operations of the systems and apparatuses disclosed herein may be performed by more, fewer, or other components and the methods described may include more, fewer, or other steps. Additionally, steps may be performed in any suitable order. As used in this document, "each" refers to each member of a set or each member of a subset of a set.

To aid the Patent Office and any readers of any patent issued on this application in interpreting the claims appended hereto, applicants wish to note that they do not intend any of the appended claims or claim elements to invoke 35 U.S.C. 112(f) unless the words "means for" or "step for" are explicitly used in the particular claim.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

We claim:

1. A post protector, comprising:

a plurality of panels, wherein said plurality of panels are planar plastic rectangular panels;

each of the panels having a C-shape with an open socket on a first side edge, the C-shape consisting of generally triangular inner corners that are contiguous to a left side and a right side of a generally flat inner back surface; and each of the panels having a catch edge on a second side edge opposite to the first side edge, wherein the plurality of panels are interconnected with one another by attaching the catch edge of each panel into the open socket of the C-shape of an adjacent panel so that the catch edge fits and conforms to the generally triangular inner corners and the generally flat inner back surface of the C-shape, wherein the post protector is adaptable to form a barrier about a post to be protected.

2. The post protector of claim 1, wherein the C shape and the catch edge molded into each planar plastic rectangular panel.

3. The post protector of claim 1, wherein the plurality of rectangular panels each have identical shapes.

4. The post protector of claim 1, wherein each of the plurality of rectangular panels includes parallel raised ribs across at least one face of the plurality of rectangular panels.

5. The post protector of claim 1, wherein the plurality of rectangular panels includes: four rectangular panels.

6. The post protector of claim 1, wherein each catch edge includes:

an arrow tip with a base clip edge.

7. The post protector of claim 6, wherein each arrow tip includes:

a half arrow shape having a right triangle configuration and a pointed tip, and the base clip edge includes a flat surface perpendicular to a side surface of each panel.

8. A method of assembling panels to protect posts, comprising:

providing a plurality of panels, wherein said plurality of panels are planar plastic rectangular panels;

providing each of the panels with a first side edge having a C-shape with open socket, the C-shape consisting of generally triangular inner corners that are contiguous to a left side and a right side of a generally flat inner back surface;

providing each of the panels with a second side edge opposite the first side edge, having catch edge; and attaching the plurality of panels to one another by interconnecting the catch edge of each panel into the open socket of the C-shape of an adjacent panel so that the catch edge fits and conforms to the generally triangular inner corners and the generally flat inner back surface of the C-shape, until the plurality of interconnected panels forms a barrier about a post to be protected.

9. The method of claim 8, wherein the step of providing the plurality of rectangular panels includes the step of:

providing the plurality of rectangular panels each have identical C shape with open socket side edges and identical catch side edges.

10. The method of claim 8, wherein the step of providing the plurality of rectangular panels includes the step of:

providing a plurality of raised ribs across one face of the panels.

11. The method of claim 8, wherein each catch edge includes:

an arrow tip with a base clip edge.

12. The method of claim 11, wherein each arrow tip includes:

a half arrow shape having a right triangle configuration and a pointed tip, and the base clip edge includes a flat surface perpendicular to a side surface of each panel.

13. The method of claim 8, wherein the step of attaching the plurality of the panels includes the steps of:

orienting and positioning the catch edge on top of the C shape so that the catch edge slides within the open socket of the C shape.

14. The method of claim 8, wherein the step of attaching the plurality of the panels includes the steps of:

pushing the catch edge sideways into the open socket of the C shape so that the catch edge snaps into the open socket of the C shape.

15. A post protector, comprising:

a plurality of panels, wherein said plurality of panels are planar plastic rectangular panels;

each of the panels having a C-shape with an open socket on a first side edge, the C-shape consisting of generally triangular inner corners that are contiguous to a left side and a right side of a generally flat inner back surface; and each of the panels having a catch edge on a second side edge opposite to the first side edge, the catch edge consisting of a half arrow tip with a base clip edge, the half arrow tip consisting of a right triangle configuration with a pointed tip, and the base clip edge consists of a flat surface perpendicular to a side surface of each panel, wherein the plurality of panels are interconnected with one another by attaching the catch edge of each panel into the open socket of the C-shape of an adjacent panel so that the catch edge fits and conforms to the generally triangular inner corners and the generally flat inner back surface of the C-shape, wherein the post protector is adaptable to form a barrier about a post to be protected.

* * * * *